US011148259B2

(12) United States Patent
Barbott et al.

(10) Patent No.: US 11,148,259 B2
(45) Date of Patent: Oct. 19, 2021

(54) UNIVERSAL DRIVE HEAD FOR OVERRIDE WRENCH

(71) Applicant: Lippert Components, Inc., Elkhart, IN (US)

(72) Inventors: Zachary Barbott, Granger, IN (US); Craig Kreil, Mishawaka, IN (US)

(73) Assignee: Lippert Components, Inc., Elkhart, IN (US)

( * ) Notice: Subject to any disclaimer, the term of this patent is extended or adjusted under 35 U.S.C. 154(b) by 302 days.

(21) Appl. No.: 16/257,759

(22) Filed: Jan. 25, 2019

(65) Prior Publication Data

US 2019/0232466 A1 Aug. 1, 2019

Related U.S. Application Data

(60) Provisional application No. 62/624,399, filed on Jan. 31, 2018.

(51) Int. Cl.

| | |
|---|---|
| ***B25B 13/00*** | (2006.01) |
| ***B25B 13/06*** | (2006.01) |
| ***B25B 13/48*** | (2006.01) |

(52) U.S. Cl.
CPC ..... *B25B 13/06* (2013.01); *B25B 13/48* (2013.01)

(58) Field of Classification Search
CPC ..... B25B 13/06; B25B 13/48; B25B 13/00; B25B 13/22; B25B 17/00
See application file for complete search history.

(56) References Cited

U.S. PATENT DOCUMENTS

| | | | | |
|---|---|---|---|---|
| 4,488,462 | A | 12/1984 | Wall | |
| 5,758,918 | A | 6/1998 | Schneider et al. | |
| 5,833,296 | A | 11/1998 | Schneider | |
| 7,810,786 | B2 | 10/2010 | Frias | |
| 8,601,662 | B1 * | 12/2013 | Rankin | E21C 35/197 29/263 |
| 8,960,256 | B2 | 2/2015 | Wagner et al. | |
| 9,175,481 | B2 | 11/2015 | Albrecht et al. | |
| 10,041,582 | B2 | 8/2018 | Greasamar et al. | |
| 10,166,657 | B2 | 1/2019 | Cummings et al. | |
| 10,239,476 | B2 | 3/2019 | Greer et al. | |
| 2007/0006689 | A1 * | 1/2007 | Carlson | B25G 1/10 81/73 |
| 2009/0236572 | A1 * | 9/2009 | Laun | B25C 11/02 254/18 |
| 2016/0121463 | A1 * | 5/2016 | Troy | B25B 15/02 81/124.5 |
| 2017/0291285 | A1 * | 10/2017 | Merrick | B25B 15/008 |
| 2019/0232466 | A1 * | 8/2019 | Barbott | B25B 13/06 |

* cited by examiner

*Primary Examiner* — Lee D Wilson
(74) *Attorney, Agent, or Firm* — Nixon & Vanderhye P.C.

(57) ABSTRACT

A drive head for a wrench is configured for operation with manually driven members of power-operated devices. The drive head includes at least first and second drive members selectively engageable with such driven members.

13 Claims, 5 Drawing Sheets

UNIVERSAL DRIVE HEAD FOR OVERRIDE WRENCH

CROSS-REFERENCES TO RELATED APPLICATIONS

This application claims the benefit of U.S. Provisional Patent Application No. 62/624,399, filed Jan. 31, 2018, the entire content of which is herein incorporated by reference.

STATEMENT REGARDING FEDERALLY SPONSORED RESEARCH OR DEVELOPMENT (NOT APPLICABLE)

BACKGROUND

A recreational vehicle (RV) may include one or more power-operated devices, for example, a power-operated awning and a power-operated jack. Such power-operated devices may include a manual override mechanism allowing a user to manually operate the accessory in the event of a power failure. Such manual override mechanisms typically include a driven member that may be engaged and rotated by a drive head of a tool, thereby enabling manual operation of the device. The driven member and drive head configurations are not standardized however. As such, numerous tools may be required for the operation of various manual override mechanisms.

BRIEF SUMMARY

It would be desirable to provide a drive head for a wrench that can be used for various-sized driven member configurations. The drive head of the described embodiments incorporates at least two drive members that can be selectively engaged with differently-configured driven members.

In an exemplary embodiment, a drive head for a wrench includes a first drive member, a second drive member keyed to and slidingly engaged with the first drive member and slidable between a first position and a second position with respect to the first drive member, and a biasing member configured to bias the second drive member toward the first position. The first drive member may include a hexagonal shaft and first and second arms extending axially from an end of the hexagonal shaft. The first and second arms may define four flats of an internal hex. The first and second arms may also or alternatively define a slot therebetween.

The second drive member may include a driven end and a drive end and an opening in the driven end, where the opening is shaped in complement to a cross-sectional shape of the first drive member. The drive head may also include an ear disposed adjacent free ends of each of the first and second arms, where the ears define a cross-sectional profile that is larger than the opening in the driven end of the second drive member.

In some embodiments, the biasing member includes a spring seat axially fixed with respect to the first drive member. In this context, the biasing member may include a spring positioned between the spring seat and the second drive member.

In another exemplary embodiment, a drive head for a wrench with a shaft includes a first drive member securable to the shaft, and a second drive member keyed to and slidingly engaged with the first drive member and slidable between a first position and a second position with respect to the first drive member. The first drive member is configured to engage a first driven member, and the second drive member is configured to engage at least a second driven member, different from the first driven member. A biasing member acts on the second drive member and biases the second drive member toward the first position. When the second drive member is in the first position, the second drive member is distal relative to the first drive member and positioned to engage the second driven member, and when the second drive member is in the second position, the first drive member is distal relative to the second drive member and positioned to engage the first driven member.

BRIEF DESCRIPTION OF THE DRAWINGS

These and other aspects and advantages will be described with reference to the accompanying drawings, in which.

DETAILED DESCRIPTION

The drawings show an illustrative embodiment of a universal drive head 10 connected to a wrench 12. The wrench 12 is shown as a speed wrench with a shaft 12*a* and a handle 12*b* or the like to facilitate rotation of the drive head 10. In other embodiments, the drive head 10 could be configured, for example, for connection to a socket wrench or to a chuck of a drill.

Figure 1:
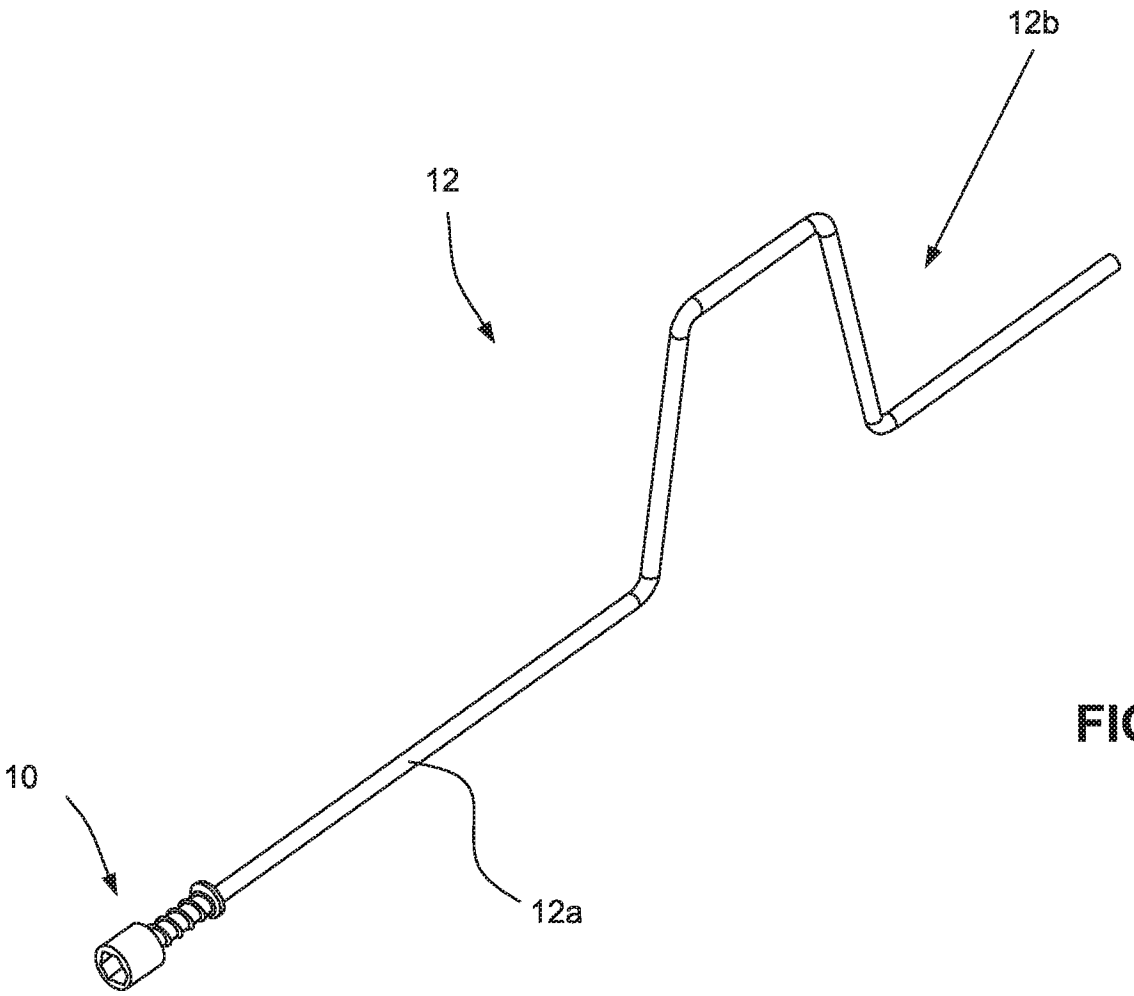
FIG. 1 is a perspective view of a universal drive head connected to a speed wrench.
Figure 2:
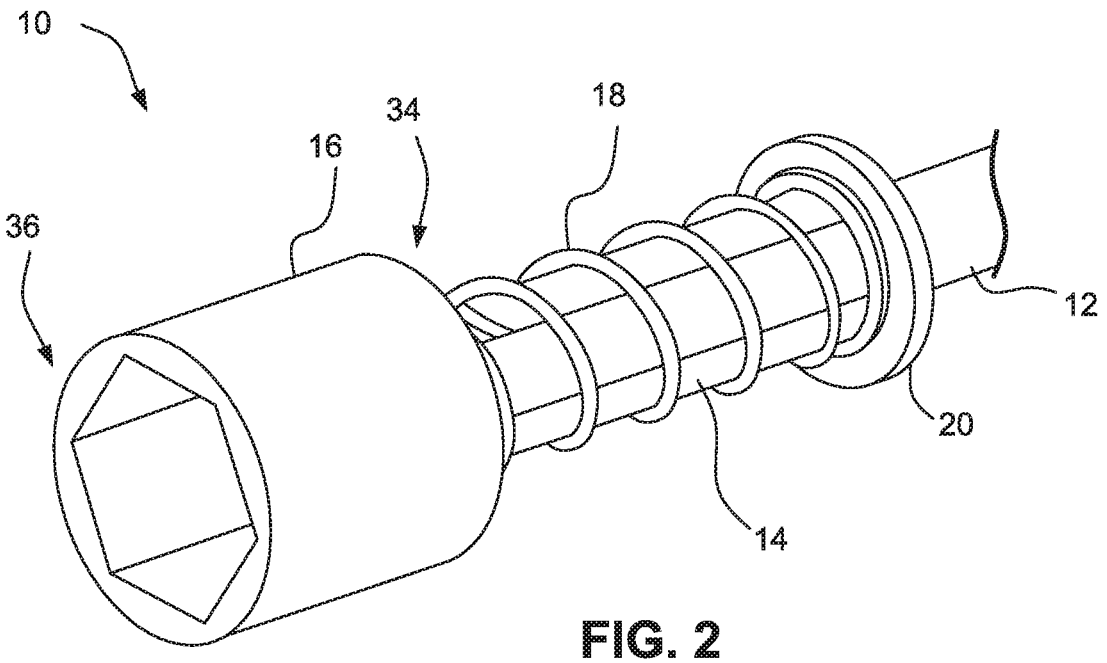
FIG. 2 is a detail perspective view of the drive head of FIG. 1 in a first configuration.
Figure 3:
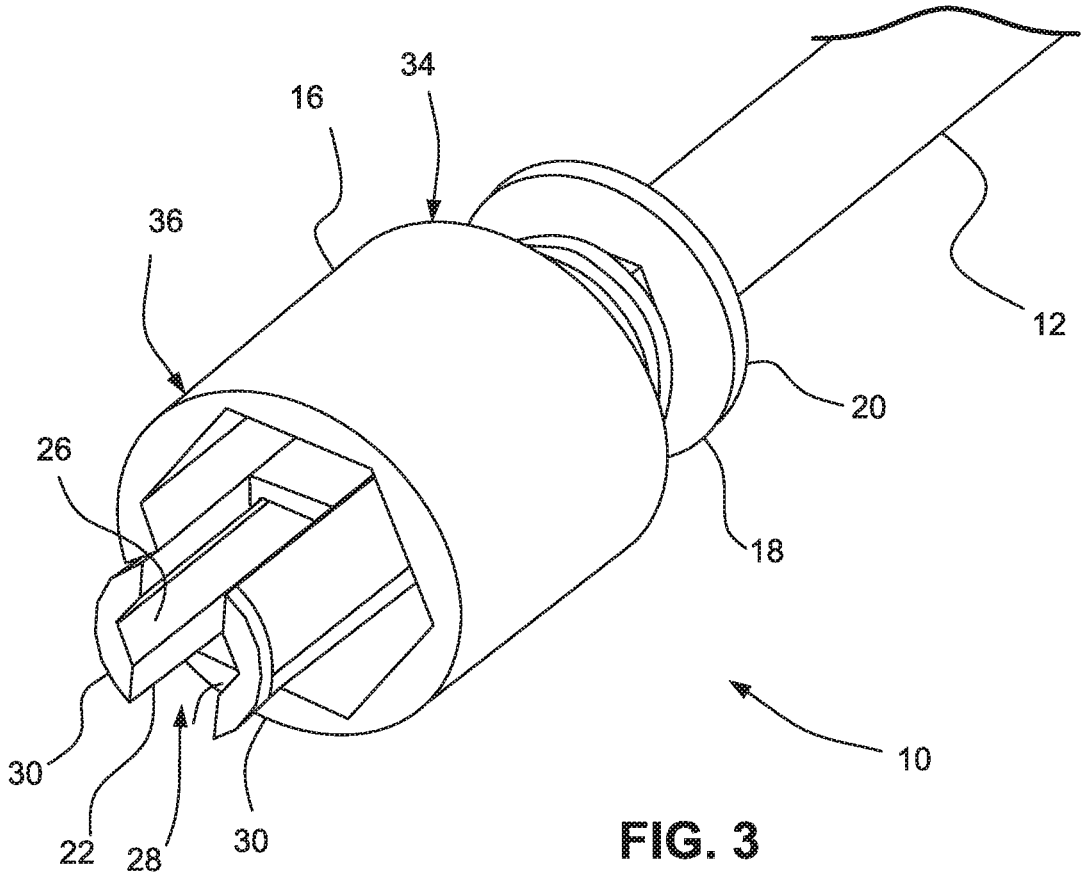
FIG. 3 is a detail perspective view of the drive head of FIG. 1 in a second configuration.
Figure 4:
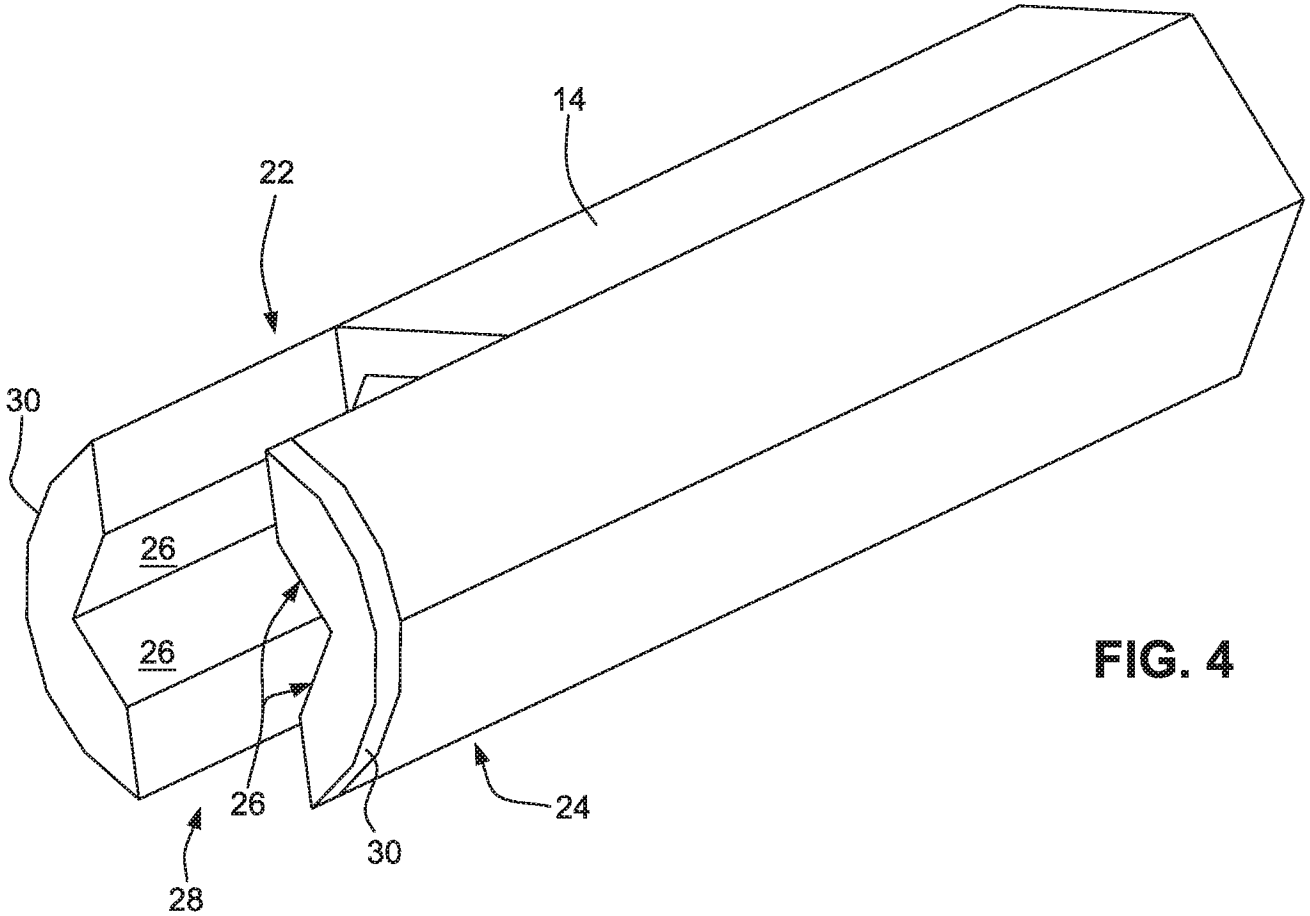
FIG. 4 is a detail perspective view of a fixed portion of the drive head of FIG. 1.
Figure 5:
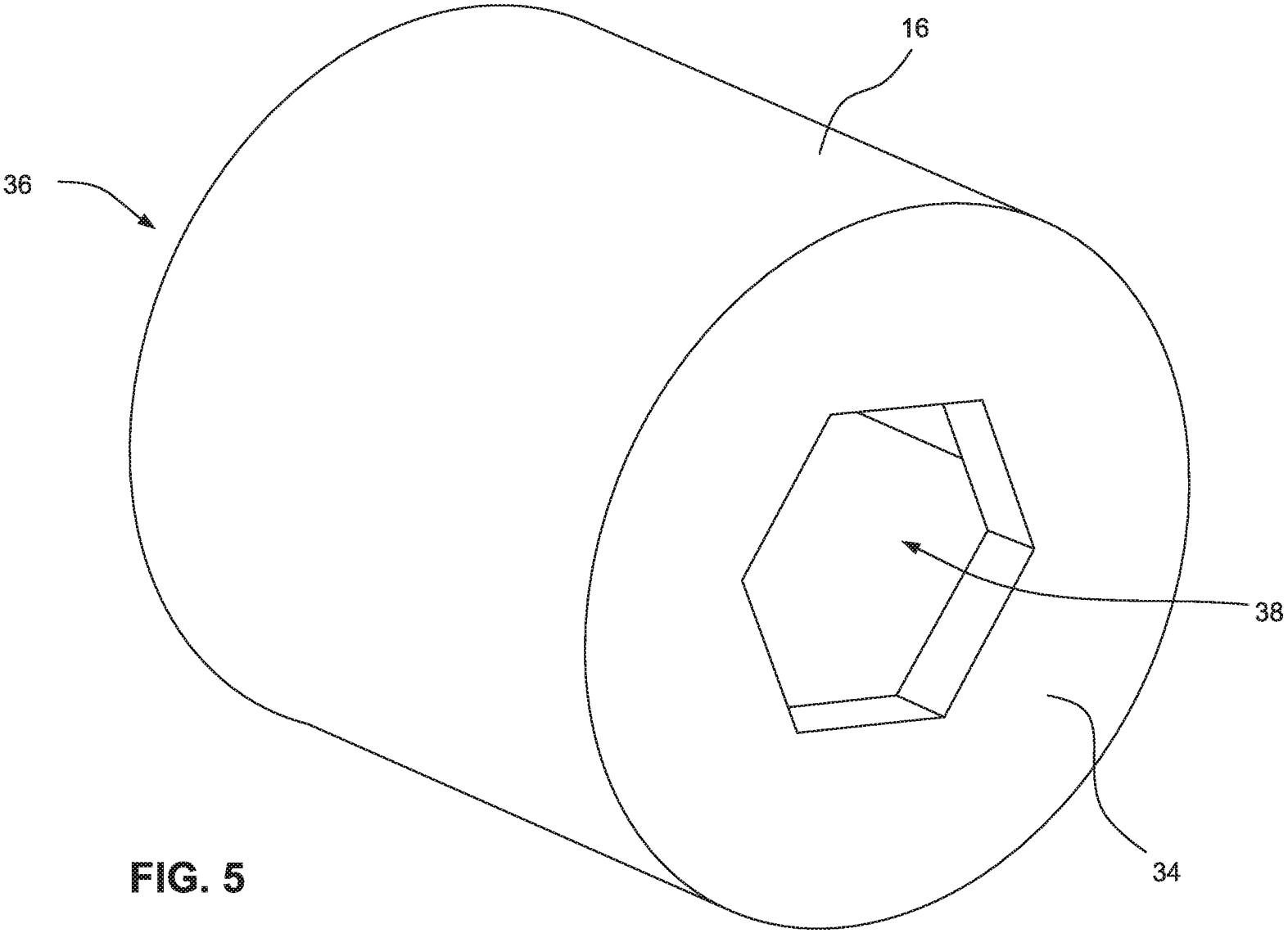
FIG. 5 is a detail perspective view of a slidable portion of the drive head of FIG. 1.

The drive head 10 includes a first drive member 14 and a second drive member 16 keyed to and slidingly engaged with the first drive member 14. The second drive member 16 is slidable between a first position and a second position with respect to the first drive member 14. The first position is shown, for example, in FIG. 2, and the second position is shown, for example, in FIG. 3. The drive head 10 also includes a biasing member 18 configured to bias the second drive member 16 to the first position with respect to the first drive member 14. As shown, the biasing member 18 may be embodied as a coil compression spring acting between an end surface of the second drive member 16 and a spring seat or perch 20 associated with and axially fixed with respect to the first drive member 14.

The first drive member 14 is shown as a hexagonal shaft having a first end, a second end, and a hollow center. The first end of the first drive member 14 may be internally threaded. The first end of the first drive member 14 is connected or connectable to the wrench 12. For example, the first end of the first drive member 14 may receive an adjacent end of the wrench 12, threadingly or otherwise. In any event, the wrench 12 may be pinned or otherwise rotationally secured to the first drive member 14 to preclude rotation of the wrench 12 with respect to the first drive member 14.

First and second arms 22, 24 extend from the second end of the first drive member 14. The first and second arms 22, 24 are defined by the omission of two opposing ones of the six sides of the hexagonal shaft. As such, the first and second arms 22, 24 cooperate to define four sides or flats 26 of an internal hex. This internal hex may be of any desired nominal size. In an embodiment, this nominal size may be 5/16". The first and second arms 22, 24, define a slot 28 therebetween. The slot 28 is configured to receive a mating flat feature of a corresponding driven member of an accessory that may be manually operated using the drive head 10 and wrench 12. An ear 30 having an arcuate outer extent is disposed at the free end of each of the first and second arms 22, 24. The ears 30 function to retain the second drive member 16 to the first drive member 14, as will be discussed further below.

The second drive member 16 is shown as a conventional hexagonal socket having a driven end 34 and a drive end 36, except that the driven end 34 of the socket defines an opening 38 configured to receive the hexagonal shaft of the first drive member 14, rather than a conventional square socket drive, in keyed engagement therewith. The opening 38 is sized complementary to the hexagonal outer surface of the first drive member 14 to permit the second drive member 16 to slide freely with respect to the first drive member 14, yet with close enough clearances to allow the first drive member 14 to transfer substantial torque to the second drive member 16 without damaging the interface between the first drive member 14 and the second drive member 16. Also, the opening 38 is sized so as to preclude the ears 30 of the first and second arms 22, 24 from passing therethrough. That is, the ears 30 have a cross-sectional profile that is larger than the opening 38. The drive end 36 of the second drive member 16 may be embodied as an internal hex of any desired nominal size.

The spring perch 20 may be connected to the first drive member 14 in any suitable manner. For example, the spring perch 20 may be attached directly to the first drive member 14 or otherwise connected between the first drive member and the wrench 12.

As mentioned above, the biasing member 18 acts on the driven end 34 of the second drive member 16 and on the spring perch 20 to bias the second drive member 16 to the first position with respect to the first drive member 14. In use, with the second drive member 16 in the first position with respect to the first drive member 14, the internal hex of the second drive member may be engaged with an external hex (not shown) of a corresponding driven member of a manual override of a power-operated device. With the driven member of the power-operated device so engaged with the second drive member 16, the wrench 12 may be used to rotate the drive head 10 and the driven member of the power-operated device in a first direction or a second direction to manually operate the power-operated device.

Figure 6:
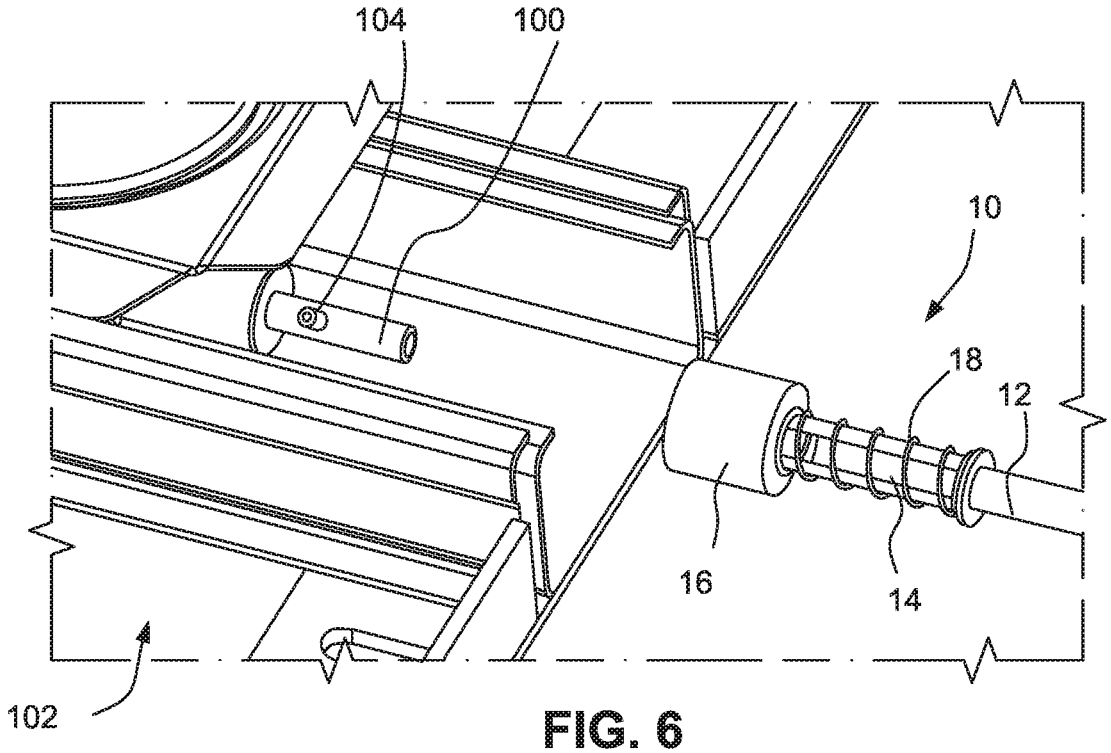
FIG. 6 is a perspective view of the universal drive head and wrench of FIG. 1 prior to engagement with a driven member of a manual override mechanism.
Figure 7:
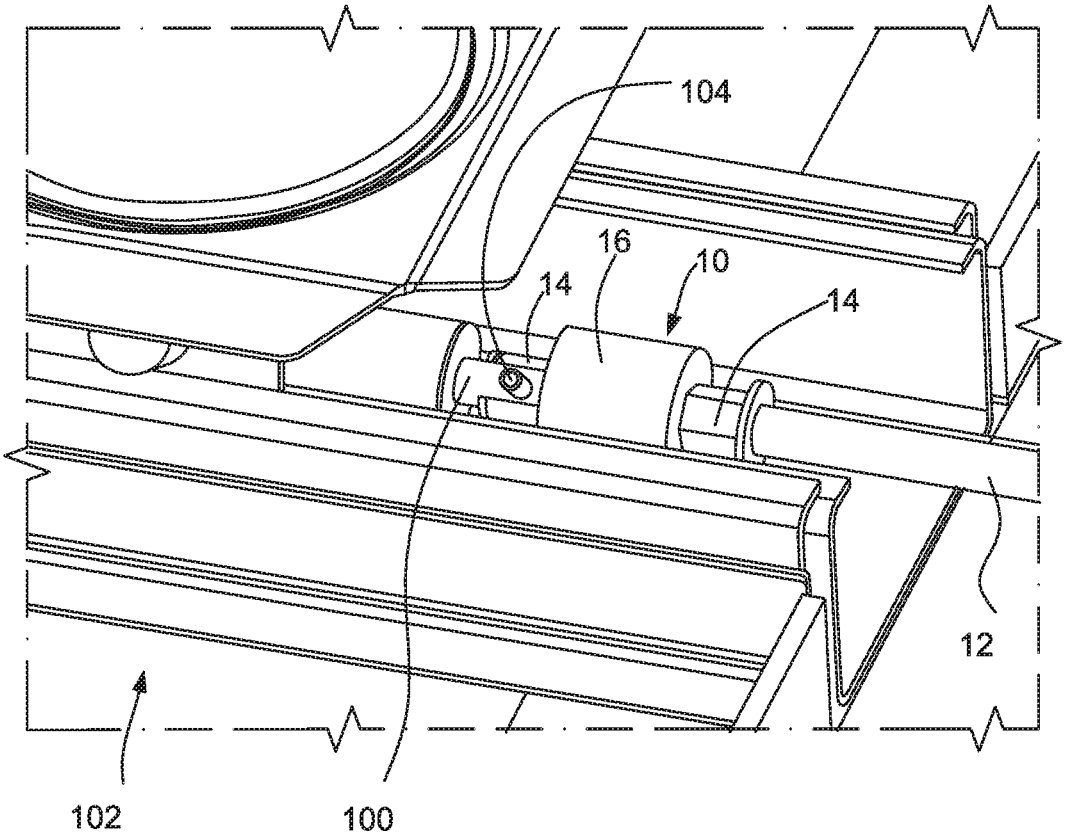
FIG. 7 is a perspective view of the universal drive head and wrench of FIG. 1 engaged with a driven member of a manual override mechanism.

Alternatively, with reference to FIGS. 6 and 7, if the internal hex of the second drive member 16 is not readily engageable with the driven member 100 of a power-operated device 102, the drive head 10 may be pressed axially against the driven member or a portion thereof, thereby causing the second drive member 16 to slide to the second position with respect to the first drive member 14, and thereby causing the first and second arms 22, 24 of the first drive member 14 to extend from within the interior of the second drive member 16. With the first and second arms 22, 24 so extended, the slot 28 therebetween may receive a flat feature, for example, a transverse pin 104 or the like, extending from the driven member 100. Alternatively, an external hex of the driven member 100 may be received within the flats 26 defining the interior region of the first drive member 14. With the driven member 100 so engaged with the first drive member 14, the wrench 12 may be used to rotate the driven member 100 in a first direction or a second direction to manually operate the device 102. Upon removal of the drive head 10 from the driven member 100, the biasing member 18 biases the second drive member 16 to the first position with respect to the first drive member 14.

Although the universal drive head 10 and wrench 12 are described herein as means to manually operate a variety of power-operated devices having different manually drivable members, the universal drive head and wrench could be used to manually operate a variety of manually-operated devices having different manually drivable members.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A drive head for a wrench, the drive head comprising:
- a first drive member;
- a second drive member keyed to and slidingly engaged with the first drive member and slidable between a first positon and a second position with respect to the first drive member; and
- a biasing member configured to bias the second drive member toward the first position, the first drive member comprising a hexagonal shaft and first and second arms extending axially from an end of the hexagonal shaft.

2. A drive head according to claim 1, wherein the first and second arms define four flats of an internal hex.

3. A drive head according to claim 2, wherein the first and second arms define a slot therebetween.

4. A drive head according to claim 1, wherein the second drive member comprises a driven end and a drive end and an opening in the driven end, the opening being shaped in complement to a cross-sectional shape of the first drive member.

5. A drive head according to claim 4, further comprising an ear disposed adjacent free ends of each of the first and second arms, the ears defining a cross-sectional profile that is larger than the opening in the driven end of the second drive member.

6. A drive head according to claim 1, the biasing member including a spring seat axially fixed with respect to the inner drive member.

7. A drive head according to claim 6, wherein the biasing member comprises a spring positioned between the spring seat and the outer drive member.

8. A drive head for a wrench including a shaft, the drive head comprising:
- a first drive member securable to the shaft, the first drive member being configured to engage a first driven member;
- a second drive member keyed to and slidingly engaged with the first drive member and slidable between a first positon and a second position with respect to the first drive member, the second drive member disposed radially outward of and surrounding the first drive member and being configured to engage at least a second driven member, different from the first driven member; and a biasing member acting on the second drive member and biasing the second drive member toward the first position, wherein when the second drive member is in the first position, the second drive member is distal relative to the first drive member and positioned to engage the second driven member, and wherein when the second drive member is in the second position, the first drive member is distal relative to the second drive member and positioned to engage the first driven member.

9. A drive head according to claim 8, the first drive member comprising a hexagonal shaft and first and second arms extending axially from an end of the hexagonal shaft.

10. A drive head according to claim 9, wherein the first and second arms define four flats of an internal hex, the internal hex being engageable with the first driven member.

11. A drive head according to claim 10, wherein the first and second arms define a slot therebetween, the slot being engageable with a third drive member, different from the first and second driven members.

12. A drive head according to claim 8, the biasing member including a spring seat axially fixed with respect to the first drive member.

13. A drive head according to claim 12, wherein the biasing member comprises a spring positioned between the spring seat and the second drive member.

* * * * *